United States Patent [19]

Munk et al.

[11] 4,058,253

[45] Nov. 15, 1977

[54] METHOD AND APPARATUS FOR CONSERVATION OF ENERGY AND CONTAINMENT AND EVACUATION OF SMOKE IN A HIGH RISE BUILDING

[75] Inventors: Michael E. Munk, Port Chester; Louis F. Bromberg, Spring Valley, both of N.Y.

[73] Assignee: Michael E. Munk, Port Chester, N.Y.

[21] Appl. No.: 559,885

[22] Filed: Mar. 19, 1975

[51] Int. Cl.[2] ..... F24F 7/06; F24F 11/00

[52] U.S. Cl. ..... 236/46 R; 98/33 R; 165/12; 169/61; 236/49

[58] Field of Search ..... 165/12, 16, 22; 236/46 R, 49; 98/33 R; 169/61; 62/231

[56] References Cited

U.S. PATENT DOCUMENTS

| | | | |
|---|---|---|---|
| 1,004,074 | 9/1911 | Powers | 236/49 X |
| 2,104,088 | 1/1938 | Lyman | 165/12 X |
| 3,884,133 | 5/1975 | Miller | 98/33 R |

*Primary Examiner*—William E. Wayner
*Attorney, Agent, or Firm*—Amster & Rothstein

[57] ABSTRACT

Apparatus is provided for use in the method of conserving energy by operating a ventilating and air conditioning system in a high rise building in a manner to permit operation of a heating and cooling unit at a reduced percentage of full capacity while adequately heating or cooling the atmosphere within the building. The method is accomplished by cycling area air supply and return dampers between fully-open and intermediate-open positions to selected floors or parts of floors within the building. The dampers are cyclically operated by electro-pneumatic actuators which are operatively connected to a central control apparatus for cycling according to a pre-determined pattern. Smoke detection sensors, located to sample air returned from selected areas of the building to be controlled, supply signals upon actuation by the presence of smoke to the central control apparatus which provides appropriate signals to operate dampers controlling air circulation to the areas of the building where smoke is detected, to create a positive pressure from non-smoke areas of the building toward the smoke area. The smoke is directly evacuated from the building without being recirculated through the air circulating system and the air circulating systems is thereby transformed into a smoke safety, life-support system.

8 Claims, 7 Drawing Figures

METHOD AND APPARATUS FOR CONSERVATION OF ENERGY AND CONTAINMENT AND EVACUATION OF SMOKE IN A HIGH RISE BUILDING

The invention relates generally to air circulation control systems and, more particularly, to a method and apparatus for conserving energy in the control of heating, ventilating and air-conditioning systems combined with a method and apparatus for converting such an energy conservation system into a system for safely containing smoke or noxious fumes in one area of a building, preventing their spread throughout the building and safely evacuating the smoke or fumes.

In multiple story, or so-called high rise buildings used for either offices or apartment dwellings, the most efficient and effective way of providing ventilation for selected individual-occupied spaces the year round and for providing, selectively, heating or cooling for these spaces when required, is a centrally located conditioning unit. Air is usually moved from such a central conditioning unit to the individually occupied spaces through ducts or passageways called supply ducts and is removed from the individual spaces and returned to the central unit through additional ducts or passageways called return ducts.

Naturally, the provision of a single, central conditioning and ventilating unit and appropriate ducts for supplying conditioned air to a plurality of spaces is much more efficient than individual air conditioning and ventilating units located in the individual spaces. However, a centrally located conditioning unit requires extensive duct work to supply conditioned air to maintain all of the individually occupied locations within the building at comfortable levels of temperature and humidity.

Distribution of a compressible fluid such as air at proper levels of temperature and humidity to a plurality of locations, through extensive duct work distant from a central source, normally includes a plurality of problems. Added to such "normal" problems in most instances is the additional problem of unequal heat loads being placed on a building owing to variation of the position of the sun relative to the building at various times during the day.

In the interest of reducing costs and conserving energy, it is desirable to normally operate most central air conditioning and ventilating units at less than full capacity. Subsequently when conditions require operation of such air conditioning and ventilating units at full capacity, the full power thereof is available to contend with the occasion.

Various systems and apparatus have been devised to utilize a central air conditioning system in the most efficient manner possible while still maintaining proper distribution of conditioned air to all occupied discrete locations within a building. For example, virtually all air conditioning supply ducts exit into the occupied spaces of buildings through registers which include louvres or dampers which are operable between a fully opened and fully closed position. However, in most instances, no provision is made for control of the individual dampers affecting the output of the central unit.

Further, if a damper is only partially closed in the vicinity of an occupied space, the rush of air past such damper often results in an annoying, high-pitched whistling or whining sound which is usually extremely objectionable to occupants of the space or selected location.

Apparatus and methods have been provided for operating dampers within air conditioning ducts selectively to shift conditioned air from one occupied space or location of a building to another as the conditioning requirements of the particular spaces change. One method of selective control of dampers to vary the location where conditioned air is supplied has involved varying such supply in timed relation to the transverse of the sun relative to the building. Naturally, such a system does not take into account conservation of energy supplied to all of the individual, specific areas.

Another system for varying the supply of conditioned air to disparate locations within a building includes the use of adjustable dampers in central air conditioning ducts coupled with changing the volume of conditioned air supplied to all individual spaces by changing the operating speed of circulating fans. Naturally, such a system does not have the advantage of long life and economy of operation associated with operation of fans at a constant rate of speed.

Often, in high rise office buildings, due to the nature of their construction, the only means of providing air to an occupied section of the building (whether conditioned or not) is through the heating, ventilating and air conditioning (sometimes abbreviated HVAC) duct work. Typically, in such buildings, unless the outside or ambient air temperature is closer to the desired interior temperature than is the circulating air (an admittedly unusual situation) the air removed from an occupied area is generally not exhausted to the atmosphere but is re-delivered to a central supply where it is recirculated throughout the building with a code-mandated amount of fresh or outside air being added thereto.

In view of the "normal" recirculation noted above, should a fire start in one of the occupied areas of the building, the smoke and noxious fumes therefrom would "normally" be removed from the fire zone, be recirculated through the HVAC system and be resupplied to other occupied areas.

In addition, as a fire builds in intensity and produces greater amounts of smoke and fumes, the additional smoke and fumes have a tendency to spread into other occupied areas, under and around doors and through corridors. Such additional smoke and fumes would be, in turn, removed through return air registers in the other areas and would be supplied, through the main HVAC supply system to other parts of the building.

Various systems and methods have been devised for rapidly and safely removing smoke and noxious fumes from an area of a high rise building and preventing its distribution to other areas of the building. For example, separate smoke evacuation or collection ducts have been provided which include smoke evacuation dampers therein which normally close separate smoke evacuation registers which communicate with the smoke evacuation ducts. During a smoke condition, the smoke evacuation dampers are opened and the area wherein the smoke has occurred is vented through the separate smoke evacuation ducts. Naturally, the just-described solution requires the installation of separate smoke evacuation ducts in addition to the normal supply and return ducts with attendant additional expense.

None of the life-safety systems or apparatus which presently exist utilize a single system of duct work for supplying the proper amount of conditioned air to an occupied space which will also function as a smoke evacuation system. In addition, none of the presently available life-safety apparatus provides positive pressure from occupied, non-smoke areas toward smoke areas to contain the smoke and which also exhaust any containments directly to atmosphere through the normal heating, ventilating and air conditioning duct work in either a new or existing structure.

It is an object of the present invention to provide heating, ventilating and air conditioning apparatus which economically provides the proper amount of conditioned air to disparate discrete locations within a building under varying temperature loads.

It is a further object of the present invention to provide an apparatus for performing the method of economically providing the required amount of conditioned air to disparate discrete occupied locations within a high rise building while simultaneously providing the capability of containing smoke substantially completely within one of said discrete locations and preventing the spread thereof to other discrete locations of the building.

It is a still more particular object of the present invention to provide apparatus for accomplishing the method of economically providing the proper amount of conditioned air to a location, evacuating smoke and noxious fumes from an area in the building where the same are being generated and accomplishing the latter object by utilizing the heating, ventilating and air conditioning duct work to perform both functions.

In accordance with a specific embodiment of the present invention, in a high rise building with a plurality of floors there is provided air-conditioning duct members and control means for normally selectively controlling the flow of air to a plurality of selected locations in the building. The flow of air is controlled by means which normally reduce and conserve the consumption of energy. In an emergency wherein smoke exists, the duct members and control means operate to contain and selectively purge the atmosphere existing in at least the one of the selected locations wherein the smoke exists. The duct members include main air passageways extending vertically between the floors in the building and at least one auxiliary supply passageway and at least one auxiliary return passageway extending horizontally at least between the main passageway and at least one of the selected locations. At least one supply register, at least one return register and at least one purge register communicate each of the selected locations with the main air passageway. At least one of the auxiliary supply passageways communicates with at least a given one of the selected locations through at least one of the supply registers. At least one of the auxiliary return passageways communicates with at least the given one of the selected locations through at least one of the return registers and through at least one of the purge registers. The control means includes main dampers which are positioned at selected locations relative to main openings of the duct members. The control means also include means for selectively operating the main dampers to control the passage of air between the main openings of the duct members and the outside of the building. At least one supply branch damper, at least one return branch damper and at least one purge damper are constructed and arranged within at least one of the passageways for controlling the flow of air into and out of each of the selected locations through the supply, return and purge registers. Main damper actuation means are operatively connected to each of the main dampers and are operable to move the main dampers between a fully opened position, permitting substantially full communication between the ducts and the outside of said building through said main duct member openings, and a fully closed position, closing off substantially all communication between the ducts and the outside of said building through the main duct member openings. Supply and return branch damper actuation means are operatively connected, respectively, to each of the supply and return branch dampers. The supply and return branch damper actuation means are operable to selectively move each of the supply and return branch dampers to a fully opened position, permitting substantially unrestricted air flow between the duct members and the selected locations through, respectively, the supply and return registers. The supply and return branch damper actuation means are also operable to selectively move the supply and return branch dampers to a fully closed position preventing substantially all air flow between the duct members and the selected locations through, respectively, the supply and return registers. The supply and return branch damper actuation means are also operable to selectively move each of the supply and return branch dampers to at least one pre-selected position intermediate the fully opened and fully closed positions. Purge damper actuation means are operatively connected to each of the purge dampers and are operable to normally move each of the purge dampers to a fulled closed position preventing substantially all air flow through the purge registers. The purge damper actuation means are also operable, in an emergency, to move the purge damper to a fully opened position permitting full communication between the selected location in communication with the purge register and the auxiliary return passageway. The control means includes means for normally cycling preselected ones of the branch supply and return dampers between the fully opened and intermediate positions in a manner to reduce and conserve the total energy necessary to supply conditioned air to the building. The control means are also operable, upon a smoke-producing emergency existing in the atmosphere of the given one of the selected locations, to actuate the purge damper in the given location to the fully opened position, to actuate the return damper at the given selected location to the fully opened position, to actuate the supply damper at the given selected location to the fully closed position, to actuate the return dampers at selected locations contiguous to the given location to the fully closed position, to actuate the supply dampers at the contiguous selected locations to the fully opened position thereby rapidly removing the smoke-filled atmosphere from the given selected location and simultaneously containing the smoke-filled atmosphere within the given selected location and preventing migration and spread thereof to other selected locations.

The above brief description as well as further objects, features and advantages of the present invention will be more fully understood by reference to the following detailed description of the presently preferred but nonetheless illustrative embodiment in accordance with the present invention, when taken in conjunction with the accompanying drawing, wherein.

Figure 1:
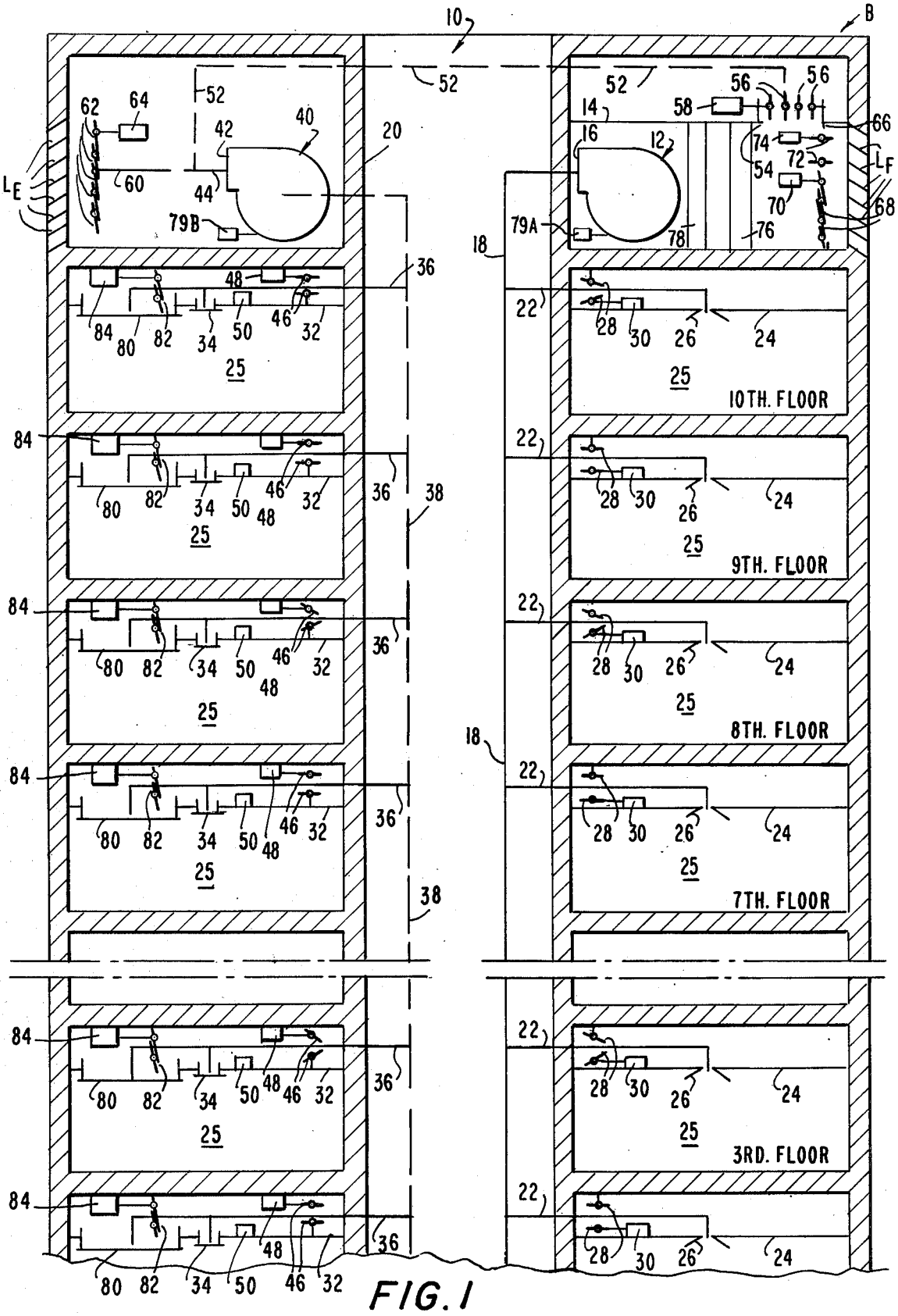
FIG. 1 is a fragmentary sectional elevational schematic representation of a high rise building illustrating objects and features of the present invention with air handling dampers shown in the "normal" condition.

Referring now specifically to the drawing and first to FIG. 1, in accordance with an illustrative embodiment demonstrating objects and features of the present invention, there is shown a high rise building generally designated by the letter B which is shown as having ten occupied floors but which may have any number of floors. The building B includes a heating, ventilating and air conditioning system demonstrating objects and features of the present invention generally designated by the reference numeral 10 and sometimes referred to solely as an air conditioning system.

The air conditioning system 10 includes an air supply fan 12 enclosed within a main supply plenum 14. An intake of the fan 12 is in communication with the interior of the main supply plenum 14. An outlet 16 of the fan 12 is in communication with a main air supply duct or passageway 18. The fan 12 is of a capacity necessary for movement of the volume of air necessary to be supplied to the building B and is of conventional design.

The main supply plenum 14, which includes therein the air conditioning apparatus to be described in greater detail hereinafter, is shown as located on the top floor of the building B. Naturally, the location shown for the supply fan 12 and the air conditioning apparatus is illustrative only and the same can be located anywhere in the building including the lower levels or the middle floor of a given building, if desired.

In the embodiment shown in FIG. 1, the outlet 16 of the fan 12 is connnected by a horizontally extending section of the main supply duct or passageway 18 to a vertically extending section thereof which extends vertically from floor to floor through the entire length of the building B through a central service corridor 20. Here again, the illustration of a central service corridor 20 within the building B is by way of illustration only, and the main supply duct or passageway 18 may extend throughout a building of different configuration in a different manner, if desired.

At each floor of the building B, provision is made for distributing conditioned air to a selected specific area such as a floor or a part thereof by means of generally horizontally extending auxiliary supply ducts or passageways 22. The auxiliary air passageways 22 are each connected in communication with the main air passageway 18 on one end, and each pass through an area supply plenum 24 which extends generally horizontally in the space above each of the selected locations 25.

The air supplied through the passageways 18, 22 and 24 enters the selected location 25 (which may be an individual room, a series of rooms, a half floor or an entire floor) by exiting from the supply plenum 24 through an inlet or supply register 26 which opens into the selected location.

An upstream end of each of the passageways 22 is selectively closable by inlet or supply branch dampers 28 which are spring-loaded closed and are operable by virtue of their connection to electro-pneumatic actuators 30 connected thereto in a manner to be described more fully hereinafter. The supply or inlet branch dampers 28 are operable, against the spring which urges them closed, to a fully opened position as shown on the ninth floor in FIG. 1. In the fully opened position, the inlet branch dampers 28 permit virtually unimpeded passage of conditioned air from the main supply passageway or duct 18 through the auxiliary supply duct or passageway 22 into the selected locations 25 on the ninth floor.

Figure 2:
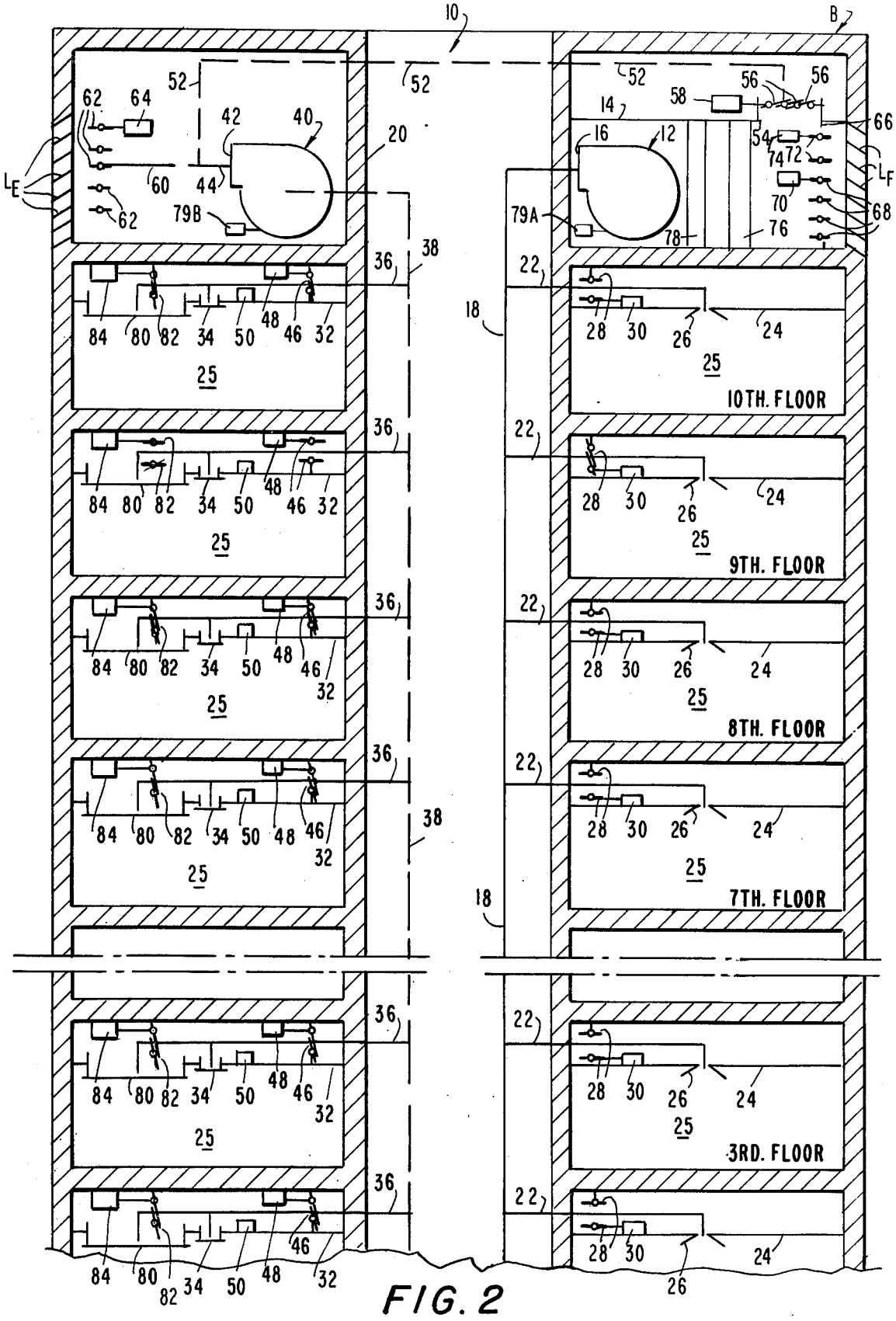
FIG. 2 is a view similar to FIG. 1 with the air handling dampers shown in position to handle a "smoke" condition.

The electro-pneumatic actuators 30 are also capable of operating the inlet branch dampers 28 (in a manner to be described more fully hereinafter) to a fully closed position as shown in FIG. 2 on the ninth floor. In the fully closed position of the inlet branch dampers 28 the supply of conditioned air from supply fan 12, through main supply passageway 18 through auxiliary supply passageway 24 is substantially completely prevented from entering into the pre-selected location 25 through inlet register 26. The reason for such a substantially complete cut-off of supply of conditioned air is for a purpose to be described in great detail hereinafter.

The electro-pneumatic actuator 30 is also operable to move the inlet branch dampers 28 to a position intermediate the fully opened position illustrated on the ninth floor in FIG. 1 and the fully closed position illustrated on the ninth floor in FIG. 2. This intermediate position for the inlet branch dampers 28, is shown, for example on the tenth floor in FIG. 1. In the intermediate position of the inlet branch dampers shown, approximately 50% of the conditioned air supplied to the selected location 25 on the tenth floor is prevented from entering the selected area on the tenth floor area and only approximately 50% of the amount of the conditioned air which the passageway 22 and register 26 can transmit does in fact enter the selected area 25 on the tenth floor, for a purpose to be described more fully hereinafter.

For a purpose and in a manner to be described in greater detail hereinafter, the actuator 30 may be adjusted and pre-set to cause any one of the inlet branch dampers 28 to which it is connected to assume an intermediate position which is different from mid-way between fully opened (see ninth floor in FIG. 1) and fully closed (see ninth floor in FIG. 2) such as is illustrated on the tenth floor in FIG. 1. This intermediate position for the inlet branch dampers 28 may be varied to suit the particular use or configuration of the selected location 25 such as it being a normally occupied office or a seldomly occupied conference room.

Alternately, the selected location may always require a full supply of air. In such a circumstance, the actuator 30 could be adjusted to operate the inlet branch damper 28 to which it was operatively connected to remain fully open even in what would normally be an "intermediate" position of actuation.

When the conditioned air enters the selected location 25 under discussion (whether it be a room, a series of rooms, a portion of a floor of a building or an entire floor of a building) it circulates therethrough. Depending upon the season, the supplied conditioned air either loses or gains heat from the air in the room through direct contact or through radiation.

An area exhaust or return plenum 32 includes an outlet, exhaust or return register 34 therein which is spaced from the supply register 26 within the selected location 25 in order to aid in the circulation of air in a manner to be described. An auxiliary return passageway 36 is in communication with the return register 34 and communicates with a main outlet, return or exhaust duct or passageway 38 which extends generally vertically for the height of the building through the service corridor 20.

Figure 3:
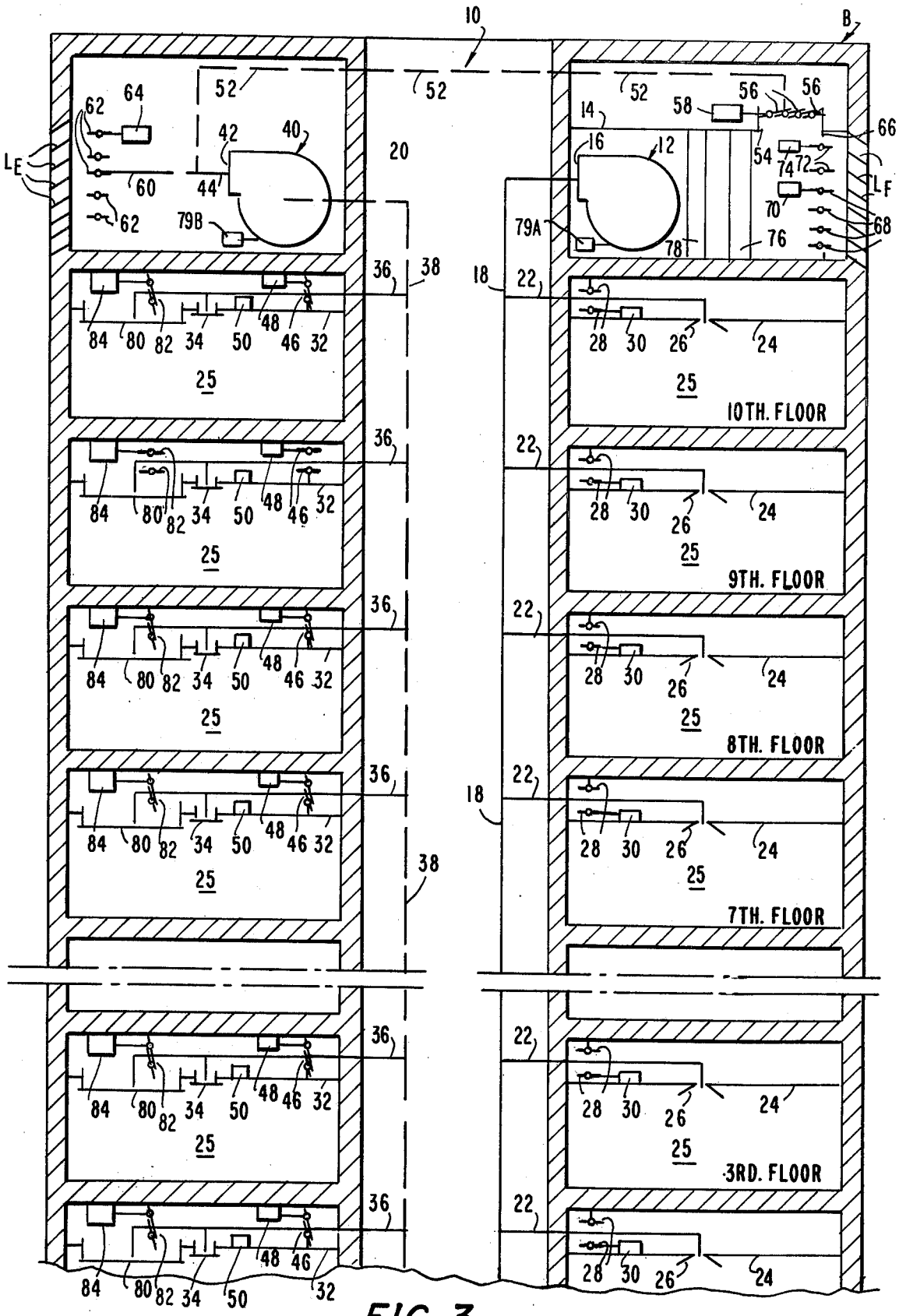
FIG. 3 is a view similar to FIG. 1 with the air handling dampers shown in the "purge" position.

In the drawing, the selected location 25 is shown in schematic, for ease of illustration, as being divided into a supply area (shown on the right in FIGS. 1, 2 and 3) and a return or exhaust area (shown on the left in FIGS. 1, 2 and 3). Naturally, the "two areas" are in fact one interconnected area.

Further, the building B shown in the schematic illustration of FIGS. 1, 2 and 3 is shown as having only one selected location 25 on each floor. Again naturally, depending on the specific design parameters of the system, each floor of the building may have several "selected locations" and the single selected location per floor which is being described herein is for illustrative purposes only and is not meant in any way to restrict the scope of the present invention. Further, the plenums 24, 32 may be eliminated and ceiling cavities used as carrier ducts.

The main return passageway 38 communicates, in turn, with the input of an exhaust or return fan 40 which may be for example, a centrifical fan or the like. The exhaust 42 of the fan 40 is connected to a main exhaust conduit 44 which branches in a manner to be described hereinafter to the inlet of the supply fan 12 and, under certain conditions to be described, to atmosphere.

The air moving through the output 42 of the return fan 40 creates a negative pressure in the main return air passageway 38, and in the auxiliary branch return passageway 36. By virtue of the communication with the return register 34 and its communication with the selected location, the negative pressure in the auxiliary return passageway creates a negative pressure at the return or outlet register 34. The negative pressure at the return register 34, which is spaced from the inlet or supply register 26, aids in the circulation of the air supplied to the selected room, floor or area through the supply register 26.

The strength of the negative pressure available at the return register 34 is controlled, in part, by exhaust, outlet or return branch dampers 46 which are located within the return plenum 32 and are located to control the air flow through the return passageway 36 and are operable by interconnection to electro-pneumatic actuator 48 to various positions to be described. The dampers 46 are, similar to the dampers 28, urged to a closed position by a spring or the like.

FIG. 1 illustrates, on the ninth floor, the fully opened position for the return dampers 46 wherein they permit virtually unimpeded flow of air through the register 34 into the auxiliary return passageway 36 to the main return passageway 38.

The tenth floor of FIG. 2 illustrates the fully closed position of the return dampers 46 wherein virtually no air is permitted to enter the auxiliary or branch passageway 36 from the tenth floor through the return register 34. In their fully closed position, the return dampers 46 are constructed and arranged to effectively completely block entrance of air from the tenth floor selected location into the main return air passageway 38 through the return register 34.

The tenth floor of FIG. 1 illustrates a position of the return dampers 46 intermediate the fully opened position thereof shown on the ninth floor of FIG. 1 and the fully closed position for the return dampers 46 shown on the tenth floor of FIG. 2.

In the intermediate position of the return dampers 46 shown on the tenth floor of FIG. 1, approximately fifty percent (50%) of the amount of air which is capable of being drawn through the return register 34, by virtue of communication thereof with the return fan 40 through the associated duct work, is permitted to enter the main return passageway 38 from the auxiliary or branch passageway 36 because of the position of the return branch dampers 46 relative to the auxiliary return passageway 36.

For a purpose and in a manner to be described in greater detail hereinafter, the actuator 48 may be adjusted and pre-set to cause any one of the return branch dampers 46 to which it is operatively connected to assume an intermediate position which is different from mid-way between fully opened (see ninth floor in FIG. 1) and fully closed (see tenth floor in FIG. 2) such as is illustrated on the tenth floor in FIG. 1. This intermediate position for the return branch dampers 46 may be varied to suit the particular use or configuration of the selected location 25 such as it being a normally occupied office or a seldomly occupied conference room.

Alternately, the selected location may always require a full supply of air. In such a circumstance, the actuator 48 could be adjusted to operate the return branch damper 46 to which it was operatively connected to remain fully open even in what would normally be an "intermediate" position of actuation. An ionization-type smoke detector 50, to be described in greater detail hereinafter, is located so as to detect the presence of smoke or other particulate matter in the air which is exhausted from the selected location 25 through the return register 34. Any convenient location for the smoke detector 50 is possible as long as it is located to sample the return air. For ease of representation, in FIGS. 1, 2 and 3, the smoke detector 50 is shown within the return plenum 32 though other locations are possible.

The main exhaust conduit 44 branches to a transfer conduit 52 which communicates with an opening 54 within the main supply plenum 14. A plurality of main transfer conduit dampers 56 are mounted between the opening 54 and the transfer conduit 52 and are operably connected to an electro-pneumatic actuator 58 in a manner to be described in greater detail hereinafter.

The electro-pneumatic actuator 58 is constructed and arranged relative to the dampers 56 so as be capable of adjusting the dampers 56 to permit virtually unimpeded entrance of air from the transfer conduit to the interior of the main supply plenum duct 14 of air supplied by the return fan 40 as shown in FIG. 1. Alternately, the actuator 58 can operate the dampers 56 to a fully closed position as shown in FIGS. 2 and 3. In the fully closed position the dampers 56 act to close off the transfer conduit 52 and substantially completely prevent the entrance, into the interior of the main supply plenum 14, of any air supplied by the return fan 40.

The main exhaust conduit 44, in addition to communicating with main transfer conduit 52, also communicates with one end of a conduit 60, the other end of which is normally closed by main exhaust or outlet dampers 62 which are operated by an electro-pneumatic actuator 64 to the normally closed position as shown in FIG. 1. With the main exhaust dampers 62 in the position shown in FIG. 1, the end of the conduit 60 is effectively sealed and no air can pass therethrough despite the communication thereof with the main exhaust conduit 44.

As may be seen by reference to FIGS. 2 and 3, the electro-pneumatic actuator 64 is capable of operating the main exhaust dampers 62 to a fully opened position wherein the conduit 60 communicates the main exhaust conduit 44 with the atmosphere on the exterior of the building B through main exhaust or outlet louvres $L_E$ located in the side of the building.

Within the main supply plenum 14 is an opening 66 open at the right end thereof. As may be seen by reference to FIG. 1, the opening 66 is normally at least partially closed by main inlet dampers 68 which are controlled by an electro-pneumatic actuator 70, operatively connected thereto, in a manner to be described more fully hereinafter.

FIG. 1 shows the "normal" position for the main inlet dampers 68, which is to close off the major communication of the interior of the main supply plenum 14, through the opening 66 with the atmosphere outside of the building B through the louvres $L_F$.

Upon operation by the actuator 70, the dampers 68 are capable of movement to a fully opened position (shown in FIGS. 2 and 3) to permit direct, full communication between the interior of the main supply plenum duct 14 and the atmosphere outside of the building B through the louvres $L_F$.

Additional communication between the interior of the main supply plenum 14 with the outside of the building B, through the opening 66 is controlled by fresh air dampers 72 which are operatively connected to and controlled by fresh air electro-pneumatic actuator 74.

In accordance with most building codes, a given percentage of fresh air must continually be supplied to an occupied building. In order to conform to this requirement, the actuator 74 is actuated to normally open the dampers 72 thereby permitting fresh air from outside of the building B to be drawn into the main supply plenum 14 through the louvres $L_F$ in communication with the part of the opening 66 in the plenum 14.

During certain conditions of start-up (discussed in detail hereinafter) the actuator 74 is signalled to operate the dampers 72 to a closed position. During such a start-up condition, the actuator 70 is also usually signalled to operate the dampers 68 to a fully closed position thereby effectively preventing entrance of any outside air into the building HVAC systems.

Located within the main supply plenum 14 is a filter 76 located between the inlet of the supply fan 12 and the opening 54 for removing foreign particles contained within air to be circulated throughout the system. Cooling and heating apparatus is contained within a heat exchanger 78 which is located between the filter 76 and the inlet of the supply fan 12. The heat exchanger 78 is a conventional design and includes cooling coils and a heating apparatus which are used as required by the heating or cooling demands of the building depending upon the season, outside temperature and occupancy.

As may be seen by references to FIGS. 1, 2 or 3, a purge register 80 is contained within the selected location 25. The purge register 80 is spaced from the inlet register 26 and communicates with the auxiliary or branch return passage 36 at the left-most end thereof. The purge register 80 communicates with the selected location 25 through an opening in the return plenum 32.

Purge dampers 82, operatively connected to an electro-pneumatic purge damper actuator 84 are constructed and arranged relative to the left-most end of the auxiliary return passage 36 to normally be in the closed position illustrated in FIG. 1 and close off substantially all communication between the selected location 25 and the auxiliary or branch return passageway 36 through the purge register 80.

Alternately, if construction permits, the purge register 80, the purge dampers 82 and actuator 84 may be mounted in a wall, in communication with return fan 40 through passageway 38.

Under certain conditions to be discussed in greater detail hereinafter, the actuator 84 is capable of operating the purge dampers 82 to a fully opened position illustrated in FIGS. 2 and 3 on the ninth floor. In the fully opened position of the purge dampers 82, virtually unrestricted communication exists between the auxiliary or branch return passageway 36 and the selected location 25 through the purge register 80. Such a fully opened position of the purge dampers 82 would virtually only exist when the smoke detector 50 detects smoke in the return air entering the auxiliary or branch return passageway 36 through the regular route, i.e., through the return register 34. The manner of operation of the purge dampers 82 (upon receipt of a signal from a central control means) will be described in greater detail hereinafter.

It should be noted that the dampers 82 are, in the preferred embodiment, spring-urged to a normally closed position and are operated to an open position by the actuator 84 upon receipt by the actuator of an appropriate signal. While all of the dampers herein are spring-urged to a closed position and operated to a fully opened or intermediate open position by actuators operatively connected thereto, such spring-urging and actuation arrangement is only illustrative of the many possible arrangements for operation of the dampers.

For example, the dampers could be merely pivoted about appropriate axes and actuated to an open, closed or intermediate position solely by movement of an appropriate actuating mechanism and control linkage. Alternately, the dampers may be spring-urged to a normally open position and operated appropriate actuators to fully closed or intermediate positions against the action of the open-urging spring.

Figure 4:
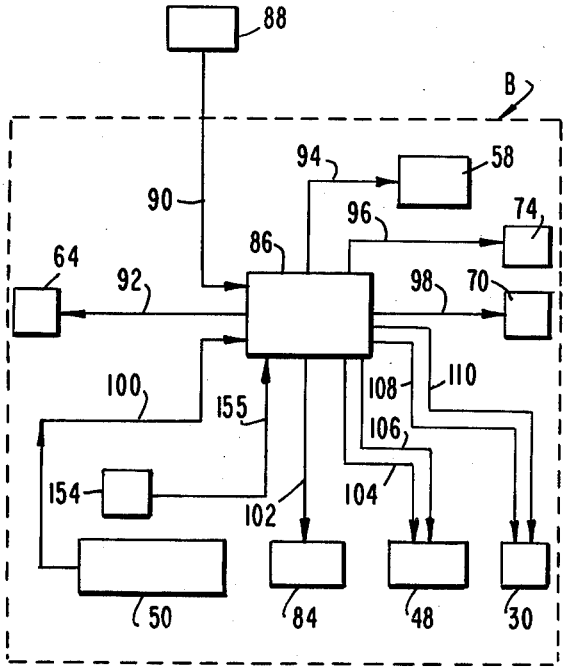
FIG. 4 is a schematic representation of the building showing some of the sensors and control apparatus of the present invention.

The control means and the interconnection thereof with the various apparatus described hereinbefore is generally shown in block schematic representation in FIG. 4.

A central control apparatus 86 is shown in FIG. 4 and, in the preferred embodiment, is a standard sensor-based digital electronic computer such as the computer offered by International Business Machines Corporation under the name System/7.

In FIG. 4 the central control apparatus 86 is indicated schematically as being a unitary element shown connected, as will be apparent from the description which follows, to one "set" of operators for a single selected location.

Even in the ten-floor building B illustrated in FIGS. 1, 2 and 3, it is obvious that at least ten selected locations exist. Further, the system of the present invention is usable with a building wherein several selected locations may be contained within each floor; and, further, is usable with high rise buildings including floors which number in multiples of ten.

In consequence of the large number of "sets" of operators which must be controlled by the central control apparatus 86, it may be necessary to interconnect various sensors and outputs to a central control apparatus or computer through a multiplexing adaptor. Such connection is accomplished, in a well-known manner, by use of a multiplexing adaptor such as the adaptor manufactured by American Multiplex under Model No. MUX2000.

Referring now to FIG. 4, an atmosphere temperature sensing device 88 is located to sense the temperature outside of the building B by any well-known means such as by measuring the deflection of a bi-metallic spring or by the use of a thermocouple or the like. The temperature sensor 88 provides a signal analogous to the atmospheric, outside or ambient temperature, through a electrical conductor 90, to the central control apparatus 86 for use in a manner to be described hereinafter.

Also connected to the central control apparatus 86 is: the main outlet damper actuator 64, by an electrical conductor 92; the transfer conduit damper actuator 58, connected through the electrical conductor 94; the fresh-air damper actuator 74 connected to the central control apparatus by electrical conductor 96; and, the main inlet damper actuator 70, connected to the central control apparatus 86 by electrical conductor 98.

As noted hereinbefore, for each selected location controlled by an inlet register 26, and by a spaced outlet register 34 and purge register 80, there is a "set" of actuators, each of which must be interconnected with the central control apparatus 86. In FIG. 4, only one representative "set" of such actuators and the sensor 50 is shown interconnected to the central control apparatus though it is to be understood that such interconnection exists for each "set" associated with each of the selected locations within the building.

Specifically: the sensor 50 is connected to the central control apparatus 86 by electrical conductor 100; the purge damper actuator 84 is connected to the central control apparatus 86 by the electrical conductor 102; the return damper actuator 48 is connected to the central control apparatus 86 by electrical conductors 104 and 106; and the supply damper actuator is connected to the central control apparatus 86 by electrical conductors 108 and 110.

Figure 5:
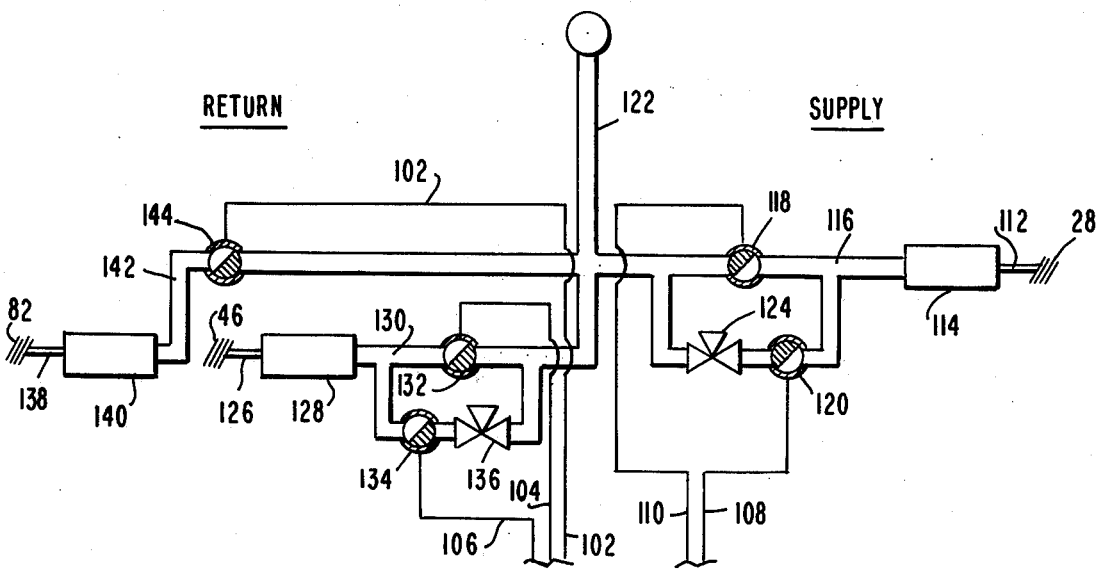
FIG. 5 is a schematic, more detailed representation of some of the control apparatus of the present invention.

FIG. 5 illustrates in detail the specific method used in the preferred embodiment to control a single "set" of inlet branch dampers, return branch dampers 46 and purge dampers 82.

The inlet branch dampers 28 are mechanically connected by link or coupling member 112 to a pneumatic motor 114 of conventional design. The pneumatic motor 114 is connected in communication with one end of a "T"-shaped pneumatic conduit 116 with the other ends of the "T" being connected to the outlets of electrically actuated pneumatic control valves 118, 120 which are connected, in turn, to central control apparatus 86 through electric conductors 110, 108 respectively.

The inlet of valve 118 is connected in communication with a central or main pneumatic supply conduit 122 where it receives a supply of pressurized air or other pneumatic-operating fluid usable to operate the pneumatic motor 114. The inlet of the valve 120 is connected, in series with a variable valve 124, to the pneumatic supply conduit 122.

The combination of the linkage 112, the motor 114, the valves 118, 120 and 124 and the various mechanical, fluidic and electrical connections just described comprise the electro-pneumatic actuator 30 in the preferred embodiment. Naturally, other actuators for the inlet branch dampers 28 are possible and within the contemplation of the present invention.

The return branch dampers 46 are operatively connected by mechanical linkage 126 to a pneumatic motor 128, also of conventional design. The pneumatic motor 128 is, in turn, connected to one end of a "T"-shaped pneumatic conduit 130. The other ends of the "T"-shaped pneumatic conduit 130 are connected to the outlets of two electrically operated pneumatic control valves 132, 134. The inlet of the valve 132 is connected in communication with main pneumatic supply conduit 122. The inlet of the valve 134 is connected, through variable valve 136, in communication with main pneumatic supply conduit 122. Electrical control of the valves 132, 134 is, respectively, through electrical conductors 104, 106 which are in communication with central control apparatus 86 (see FIG. 4).

The combination of the linkage 126, the motor 128, the valves 132, 134 and 136 and the associated mechanical, electrical and pneumatic interconnection described above comprises the electro-pneumatic actuator 48 in the preferred embodiment of the subject invention. Here, too, the described preferred electro-pneumatic actuator may be replaced by equivalent mechanisms and still be within the contemplation of the subject invention.

The purge dampers 82 are operatively connected, through mechanical linkage 138, to a pneumatic motor 140 of conventional design. Pneumatic motor 140 is connected, through pneumatic pressure conduit 142 to the outlet of an electrically operated pneumatic control valve 144. The inlet of the valve 144 is connected in communication with the main pneumatic supply conduit 122. Electrical control of the valve 144 is through electrical conductor 102 which communicates with the central control apparatus 86 (see FIG. 4).

The mechanical linkage 138, the pneumatic motor 140, the valve 144 and the associated mechanical pneumatic and electrical interconnection described hereinbefore comprises the purge register actuator 84 utilized in the preferred embodiment. Here, too, the actuator described may be replaced by equivalent apparatus and still be within the contemplation of the present invention.

In operation, the central control apparatus 86, under circumstances to be described in detail hereinafter, provides an electrical signal along the electrical conductor 110 to the valve 118 which shifts in response thereto. The shifting of the valve 18 permits fluid under pressure from main pneumatic supply conduit 122 to enter the conduit 116 and cause the motor 114 to operate the inlet branch dampers 28 through the mechanical linkage 112.

Upon an electrical signal no longer being received by the valve 118, the valve shifts back to its original or "normal" position shown in FIG. 5 thereby blocking entrance of any further pressurized fluid into the motor 114 and permitting the inlet branch dampers 28 to return to the "normal" position if appropriate venting is provided for the pressurized fluid.

Upon a signal being received by the valve 120, along the electrical conductor 108 from the central control apparatus 86, the valve shifts permitting pressure to enter the conduit 116 from the main pneumatic supply conduit 122 through the valve 124. The valve 124 may be pre-adjusted to control the amount of pneumatic fluid which enters the motor 114, thereby controlling the amount of movement, through the linkage 112, of the inlet branch dampers 28 by the motor 114.

Upon cessation of the electrical signal received by the valve 120, it shifts back to the position shown in FIG. 5 thereby blocking the entrance of any pneumatic fluid into the motor 114 from the main pneumatic supply conduit 122. The biasing means returns the inlet branch dampers 28 to their "normal" position with provision being included in the conduit 116 or in the motor 114 for venting the pressure within the conduit 116.

The return branch dampers 46 which, as noted above, may be biased by a spring or like-biasing means to a "normal" position (such as being fully opened to permit relatively unrestricted flow of return air through the return air registers 34) are moved from that position to a fully closed position by valve 132 shifting upon receipt of an electrical signal through electrical conductor 104 from central control apparatus 86. Upon receipt of such a signal and shifting of the valve 132, pneumatic fluid under pressure communicates with the motor 128 through the interconnection described before of the motor 128 with the main pneumatic supply conduit 122.

Upon cessation of the electrical signal received by the valve 132, it shifts back to the closed position illustrated in FIG. 5 thereby blocking any further pneumatic fluid from entering the motor 128 through the conduit 130 and the urging or biasing means moves the branch dampers 46 back to the normal position with pressure within the motor and/or conduit being appropriately vented.

Upon the valve 134 receiving an electrical signal through the electrical conductor 106 from the central control apparatus 86, the valve shifts from the closed position shown in FIG. 5 and permits an amount of pressurized fluid controlled by the valve 136 to enter the motor 128 through the previously described interconnection with the main pneumatic supply conduit 122. The amount of pneumatic fluid which enters the motor 128 controls the amount which the return branch dampers 46 will move. Here, again, upon cessation of the receipt of the electrical signal by the valve 134, it returns to the "normal" closed position shown in FIG. 5 and the biasing means returns the return branch dampers 46 to their "normal" position.

Biasing means normally urge the purge dampers 82 to a closed position blocking any communication between the selected location 25 and the auxiliary return passageway 36 through the purge register 80. Upon receipt of an electrical signal along the electrical conductor 102 from the central control apparatus 86, the valve 144 shifts from its normally closed position shown in FIG. 5 and permits pressurized pneumatic fluid to enter from the main pneumatic supply conduit 122, through the conduit 142, causing the pneumatic motor 140 to move the dampers 82 to the fully opened position through the mechanical linkage 138.

Upon cessation of the electrical signal being received by the valve 144, the biasing means again moves the purge dampers 82 to the fully closed position and the pressure contained in the motor 140 and/or the conduit 142 is vented, according to well-known procedures, using well-known apparatus.

Figure 6:
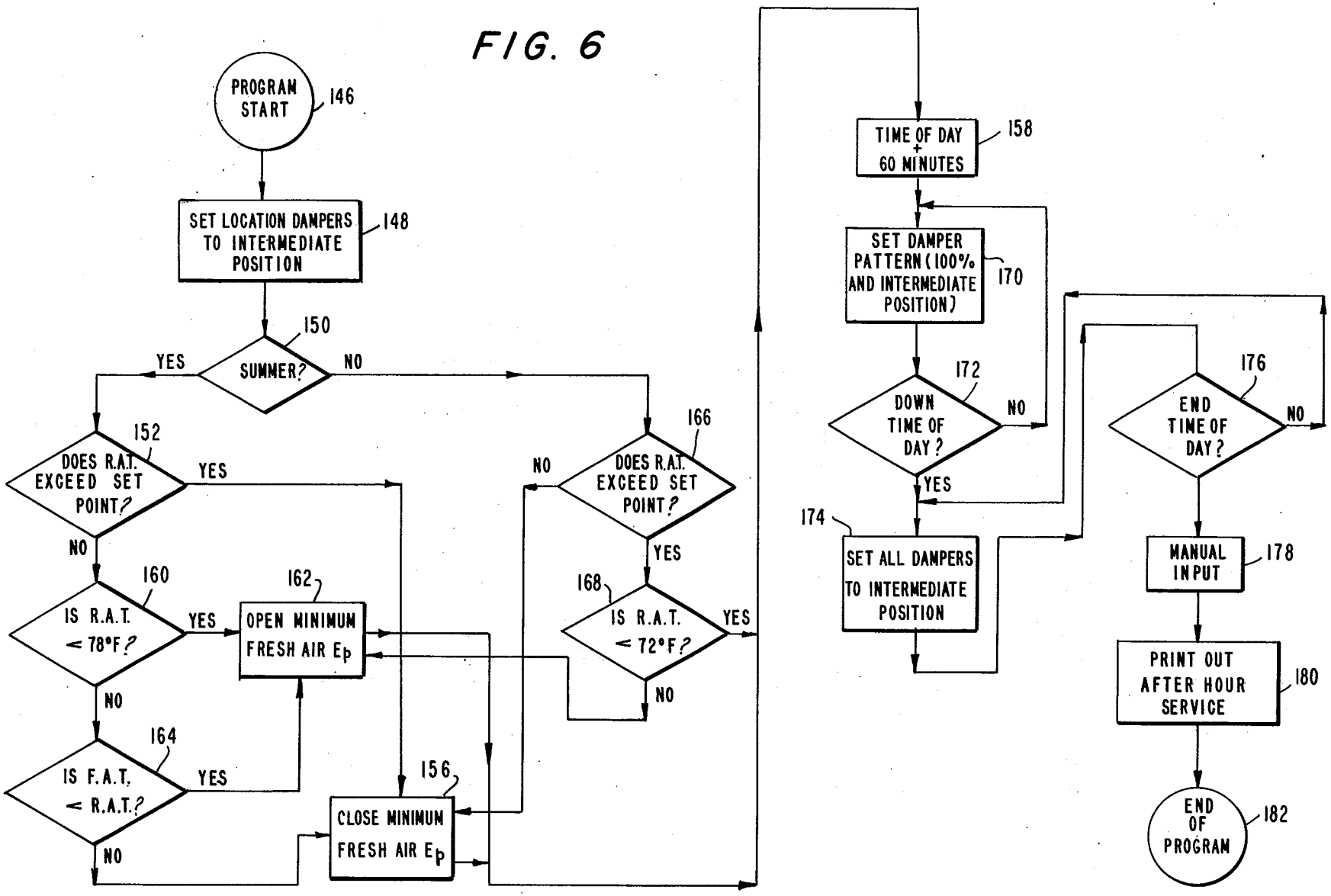
FIG. 6 is a schematic representation of a method and control apparatus for operating an air distribution system according to the present invention in the "normal" mode to conserve energy; and, FIG. 7 is a schematic representation of a method and control apparatus for operating an air distribution system according to the present invention in the "emergency" mode to contain and evacuate smoke.

The procedural combination of steps carried out by the central control apparatus 86 to effectuate the normal, energy-conserving function of the subject invention noted hereinbefore is diagrammed in FIG. 6. Referring now to FIG. 6, the program within the central control apparatus 86 is initiated, as is indicated by the block 146 in FIG. 6.

The start of the program may be initiated by an individual operator closing a circuit located at a central control keyboard. Alternately, the program may be initiated by a simple clock mechanism which starts to operate the program within the central control apparatus 86 at a specified time of day. The "start-up" or "initiation" time of day may vary with the time of proposed full occupancy of the building and in one form of the present invention would be sixty minutes prior to proposed full occupancy of the building.

This "start-up" to "occupancy" time factor is naturally variable and might depend on numerous factors such as the outside air temperature vis-a-vis the inside air temperature of the building, the physical capacity of the air-conditioning and ventilation system, the efficiency of the heating and/or cooling plant contained within the heat exchanger 78 and numerous other factors.

The initial function which is performed by the central control apparatus 86, once the program starts, is, as indicated in block 148, to set all "selected location" dampers to the intermediate position by sending appropriate signals through electrical conductors 106, 108. The signals received by the respective valves 134, 120, (through the procedure and conductors noted hereinbefore with respect to the operation of the aforesaid valves in conjunction with the description of the apparatus noted in FIG. 5) sets all of the return and supply dampers 46, 28 to their intermediate position.

Consequently, when the system starts up, the individual supply and return dampers 28, 46 are set to their intermediate position. In addition, the main inlet and outlet dampers 68, 62 are closed, the main transfer conduit dampers 56 are opened, the minimum fresh air dampers 72 are opened and the purge dampers 82 are closed.

In general, the central control apparatus 86 does not forward an electrical signal along electrical conductor 102 to move the purge dampers 82 from their normally closed position. The reason is that by moving the supply and return dampers 28, 46 to their intermediate position, the system is balanced and the same volume of air supplied to a given selected location 25 through the supply register 26 can be removed from the given selected location through the return register 34 which is horizontally spaced therefrom, within the given selected location.

Next, the decision element 150 is progressed to. The decision element 150 receives an input from the outside temperature sensor 88 and compares the input received therefrom with a seasonal set point which has been pre-set within the central control apparatus 86. If the outside air temperature is above the pre-set seasonal set point (which, naturally, may be varied), as determined by the decision element 150, a "yes" answer is provided to the "summer?" question and the decision element 152 is progressed to.

A temperature sensor 154 (see FIG. 4) is located within the return air plenum 32 in a position to sample the temperature of the air drawn into the auxiliary return passageway 36 and may be housed within the same housing as the return fan 40. The return air temperature sensor 154 provides a signal analogous to the temperature of the return air, along electrical conductor 155, to the central control apparatus 86. The decision element 152 utilizes the signal which is analogous to the return air temperature and the return air temperature is compared with a predetermined, pre-set, comfort set point, which, of course, can also be varied.

If the return air temperature is greater than the comfort set point, a signal is provided to block 156 which causes the central control apparatus 86 to send a signal along the electrical conductor 96 to operate the actuator 74 and close the minimum fresh air dampers 72 which are operatively connected thereto. This closing of the dampers 72 prevents the entrance of even the normally "legal" amount of fresh air into the main supply plenum 14 thereby maximizing the cooling effect of the passage of air through the heat exchanger 78.

With the conditions as described hereinbefore (i.e., the outside air temperature being above the seasonal set point as determined by the decision element 150 and the return air temperature exceeding the comfort set point as determined by the decision element 152 and the minimum fresh air dampers 72 closed) block 158 is progressed to. When the "start-up" time of day, plus sixty minutes is reached, the "normal routine" commences. Naturally, the time between the "start-up" time of day and the start of the "normal routine", as noted hereinbefore, may be greater or less than sixty minutes as desired.

If the decision element 152 determines that the return air temperature does not exceed the comfort set point, decision element 160 is reached. Decision element 160 determines whether the return air temperature is less than 78° Fahrenheit (an arbitrary set point which can be varied). If the decision element 160 answers "yes", that the return air temperature is less than 78° (and if the decision element 150 has determined that the outside air temperature is above the seasonal set point and the return air temperature has not exceeded the comfort set point and is less than 78° Fahrenheit) block 162 is reached.

At block 162, a signal is provided by the central control apparatus 86 along the electrical conductor 96 to cause the actuator 74 to open the minimum fresh air dampers 72 and block 158 is reached until the preselected time after the "start-up" routine occurs (here, start-up time plus sixty minutes).

If the decision element 160 determines that the return air temperature is not less than 78° Fahrenheit (i.e., answers "no" to the question posed), decision element 164 is reached. Decision element 164 inquires whether the fresh air temperature (as sensed by the outside temperature sensor 88) is less than the return air temperature (as sensed by the return air temperature sensor 154). If the answer is "yes" from decision element 164 (the fresh air temperature is less than the return air temperature), then block 162 is reached and the minimum fresh air dampers 172 are opened and the procedure described hereinbefore from block 162 is followed. If the answer is "no" from decision element 164 (the fresh air temperature is not less than the return air temperature), block 156 is reached and the minimum fresh air dampers 72 are closed and the procedure described hereinbefore from block 156 is followed.

If the decision element 150 determines that the outside temperature is not above the seasonal set point and, consequently, answers the "summer?" question with a "no", the decision element 166 is reached. The decision element 166 questions whether the return air temperature exceeds a comfort set point (which may be the same as the comfort set point described in conjunction with decision element 152 or may be a different comfort set point). If the return air temperature does not exceed the set point, i.e., the question of the decision element 166 is answered "no", the block 156 is reached, the minimum fresh air dampers 72 are closed and the procedure described hereinbefore from block 156 is followed.

If the decision element 166 determines that the return air temperature does exceed the set point, i.e., the question is answered "yes", decision element 168 is reached. Decision element 168 questions whether the return air temperature is less than 72° Fahrenheit (here, again, this is a variable set point). If the return air temperature is less than 72° F., i.e., the question of the decision element 168 is answered "yes", block 158 is reached and the procedure described hereinbefore is followed.

If, on the other hand, the decision element 168 determines that the return air temperature is not less than 72° F., i.e., the question is answered "no", block 162 is reached and the central control apparatus effectuates the opening of minimum fresh air ducts 72 and the procedure described hereinbefore from block 162 is followed, i.e., to progress to block 158.

It should be noted that during all of the "start-up" procedure described hereinbefore, the supply and return fans 12, 40 have been operating either at full capacity or at a pre-determined percentage, for example 75%, of their total capacity, depending upon the specific needs of the building. Now, as the "normal" time of day approaches (the "time of day plus sixty minutes" noted in block 158), the fans 12, 40 will be normally operating at only a stated percentage of their full or rated capacity in order to effectuate energy conservation as described in greater detail hereinafter.

The "time of day plus sixty minutes" noted in block 168 (which may be varied depending upon the requirements of the system) may be determined by a simple clock mechanism or may be determined by any other conventional means.

When the block 158 is reached and the "normal" ("time of day plus sixty minutes") time of day occurs, block 170 is reached. When block 170 is reached, the minimum fresh air dampers 72 are opened to comply with local regulations as the building B being controlled is presumed to be fully occupied, or is about to be fully occupied. In addition, the main inlet and outlet dampers 68, 62 are closed, the purge dampers 82 remain closed and the normal supply and return dampers 28, 46 are set in a pattern to be described.

In the normal operations of a heating, ventilating and air conditioning system, the fans are operated at full rated capacity for a given amount of time. Periodically, in an effort at conserving and reducing the consumption of energy, the fans are either shut down entirely or reduced to a percentage of their full or rated capacity for a given amount of time.

In view of the fact that most building codes require that a certain volume of air be moved through a given selected location in a given amount of time, the amount of either complete shut-off or operation at reduced capacity for the supply and return fans of normal systems can only be relatively short. This requires constant cycling of fans and not only wastes energy owing to the inertia of such fans but also greatly reduces the total usable life of the fan motors.

In the present invention, in order to prevent the cycling of the fan motors, the supply and return fans 12, 40 are run at a given percentage of their total full or rated capacity, for example 75%, for the entire time of their operation by use of standard vortex inlet vanes for capacity reduction. This reduction in level is maintained throughout the operation under the "normal" mode of operation. The reduced air flow which results from the reduced fan rate of operation reduces the number of cubic feet of air per minute passing the heat exchanger 78. This reduction in air volume permits a reduction in the total energy required for heating or cooling the volume of air passing through the system.

The building B which is being supplied with air circulated by the supply and return fans 12, 40 is provided with adequate ventilation and adequately conditioned air through periodic cycling of the supply and return dampers 28, 46 servicing a given selected location 25 between the fully open position and the intermediate open positions described hereinbefore.

By always maintaining a "set" of supply and return dampers 28, 46 servicing a given selected location 25 at the same condition (i.e., either both open fully or both at their respective intermediate positions) there is virtually no excess pressure build up or decrease within a given selected location by use of standard fan performance controls 79A, 79B which may be variable inlet vanes or fan motor speed reduction means.

Further, by maintaining a given selected location at a condition of throttled or "intermediate" air circulation for a relatively small amount of time (on the order of five or ten minutes out of an hour total for each given selected location) a minimum or non-existent amount of discomfort is imparted to the occupants of the given selected location and full compliance is had with the air change requirements of virtually all building codes.

Naturally, for any given specified location, the valves 124, 136 controlling the intermediate position for the dampers 28, 46 may be varied to provide a comfortable level of conditioned air to the specific space under virtually all conditions of use. In addition, the central control apparatus 86 can be programmed to fully close down the supply and return dampers 28, 46 to certain areas which are known not to be used except during certain specific times of the day.

Under the "normal" mode of operation, at any given moment, approximately 50% of the supply and return dampers 28, 46 in the building B are operating at the intermediate position and the other 50% are operating at the fully open position. Assuming for ease of computation that the intermediate position permitted air flow of approximately 50% of the fully open position, only 75% of the total air-handling capacity of the supply and return fans 12, 40 is required at any given moment and fan performance controls 79A, 70B will so modify the fan output. If the cycling of the dampers 28, 46 is maintained so that the specific selected locations receiving a throttled or "intermediate" air flow are varied according to predetermined sequence, the aforementioned savings in and conservation of energy will be effectuated without having the supply and return fans 12, 40 constantly cycled between full and partial performance. Rather, the supply return fans 12, 40 will be operating virtually constantly during the day at approximately 75% of rated capacity under control of fan performance controls 79A, 79B.

It is conceivable that the outside temperature sensor 88 can supply a temperature analogous signal to the central control apparatus 86 that the outside air temperature is approaching a level wherein either the heating or cooling capacity of the system (operating at full capacity all the time) would be or is reached. Upon receipt of such a signal, the central control apparatus 86 can cease fibrillation of the inlet and outlet dampers 28, 46 between the fully open and the intermediate open positions. In such a circumstance, the supply and return fans 12, 40 are operated at full, rated capacity and the supply and return dampers 28, 46 are left at their fully open position.

In addition, to supply further heating or cooling capacity, for certain limited amounts of time in accordance with the requirements of the applicable building codes, the minimum fresh air dampers 72 may be closed.

Throughout the normal fibrillation period of operation resulting in conservation of energy, the decision element 172 is constantly questioning whether the shut-down time of day has approached. The shut-down time of day (which may be controlled by a clock) occurs when the building begins to cease being fully occupied and when, therefore, the cooling or heating or ventilating requirements of the building would be reduced. If the shut-down time of day has not been reached, the damper fibrillation functions are maintained. If the shut-down time of day has been reached, block 174 is progressed to wherein all of the supply and return dampers 28, 46 are set to the intermediate position, the output of the supply and return fans 12, 40 may be reduced still further (to, for example, 50% of full capacity) and the decision element 176 is reached.

The decision element 176 inquires whether the end of the day has been reached. The end of the day is when the building will be, with the exception of the cleaning personnel, essentially unoccupied.

If the decision element 176 determines that the end time of day has not been reached (a function of the specific building and which may be controlled by a clock), the intermediate position of the dampers noted within the block 174 is maintained. When the decision element 176 determines that the end time of day has been reached, the block 178 is reached.

At block 178 a control keyboard can be manually set to specifically supply conditioned air at the normal fibrillation pattern basis to after-hour areas wherein building occupants will be operating after most of the building occupants have left for the day. This may be done by setting a simple clock to maintain the after hour fibrillation pattern service to the preselected locations for a pre-determined time. Since the fans 12, 40 are now presumably operating at a still further reduced rate (for example 50% of capacity) the air volume supplied is less than normal but so also presumably is the occupation of the given pre-selected location.

Next, block 180 is reached within a signal is provided an appropriate printing apparatus of conventional design to print out the specific areas wherein after-hour service is required. This print-out information may be used later for billing the occupants of the locations wherein after-hour service is required for the extra consumption of energy required by providing more than the normal service. Finally, after all after-hour service has ceased, the "normal" program ends as noted in block 182.

The above-described "normal" (fibrillation damper pattern) functioning of the apparatus of the present invention to conserve energy by cycling or fibrillating the inlet and outlet dampers 28, 46 between fully open and intermediate open positions can be seen by reference to FIG. 1. For example, on the tenth floor of the diagram of the building B shown in FIG. 1, both the inlet branch dampers 28 and the return branch dampers 46 have been operated by the respective electro-pneumatic actuators 30, 48 to the intermediate open position thereby supplying and exhausting air from the selected area 25 on the tenth floor at a reduced rate and volume.

In a similar manner, the third and eighth floors of the building B shown in FIG. 1 have their respective inlet branch dampers 28 and return branch dampers 46 set at the intermediate open position for exchanging air in the respective selected locations shown on the third and eighth floors at a reduced rate and volume.

It should be noted that the normal flow of air past dampers 28, 46 in the intermediate position shown on the third, eighth and tenth floors might present a noise problem created by turbulence of the air rushing over the edge of the respective dampers. This noise problem may be dealt with by appropriately configuring the edges of the dampers or by locating the dampers 28, 46 a given distance from the registers 26, 34 within the plenums 24, 32 or by providing sufficient sound-deadening material within the plenums to prevent the noise from being objectionable to occupants of the selected locations.

As may be noted by reference to FIG. 1, the second, seventh and ninth floors of the illustrated building B have the inlet branch dampers 28 and the return branch dampers 46 adjusted to their fully open position thereby permitting supply to and exhaust from the selected locations 25 on the third, seventh and ninth floors at the full rate and volume of air supply and removal.

Naturally, as noted hereinbefore, the specific floors or selected locations supplied with air at a reduced rate by cycling the supply and return dampers controlling the air supply to that selected location from fully open to intermediate open position is varied according to a pre-determined pattern to eliminate any discomfort felt by occupants of the specific locations and comply with local building codes.

Figure 7:
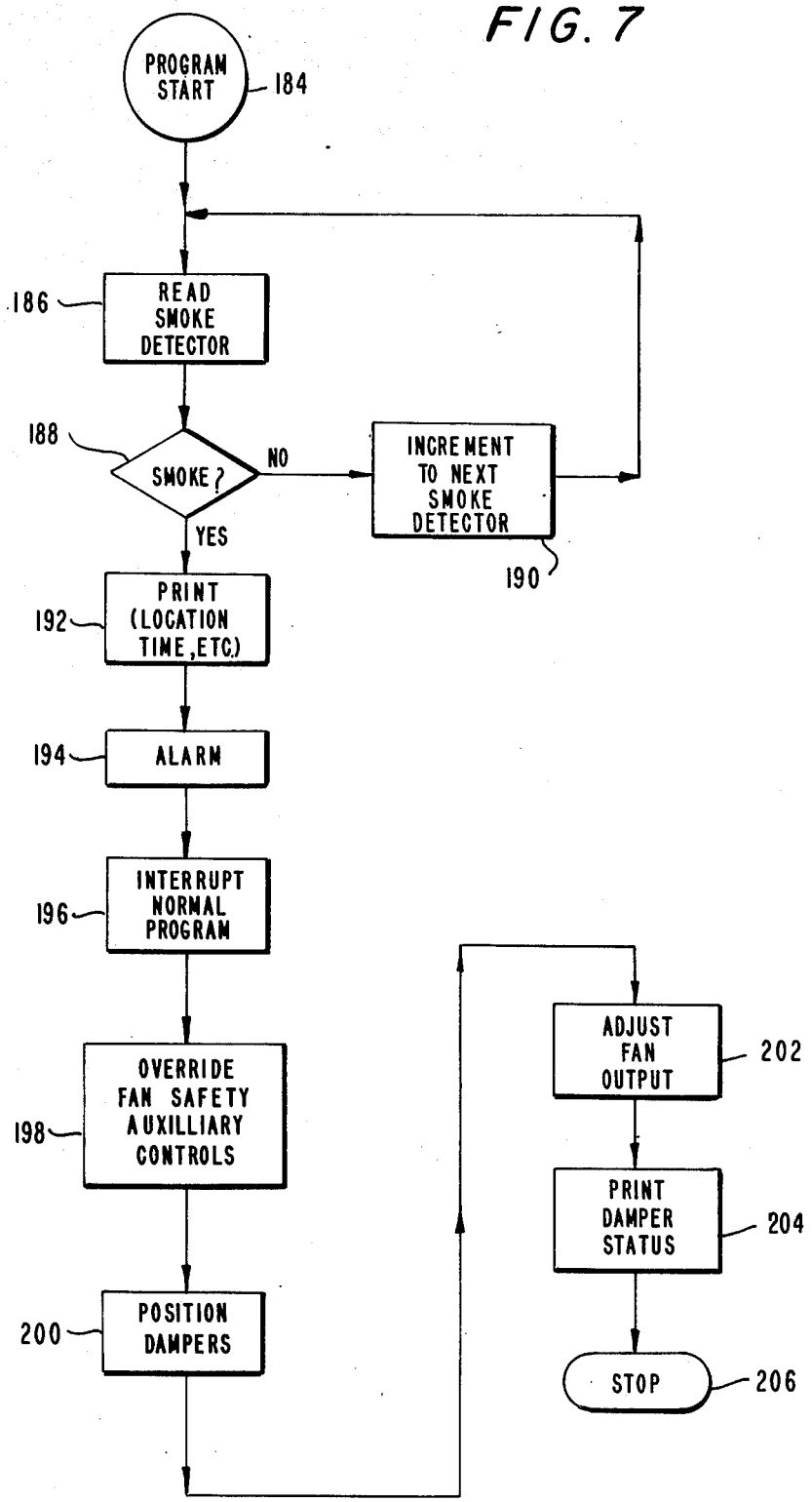

FIG. 7 illustrates, in diagrammatic fashion, the procedural combination of steps which the central control apparatus 86 and associated mechanism engages in to render the normal heating, ventilating and cooling duct work and system just described operable as a life-safety system for control of smoke or other noxious fumes. Block 184, indicates that the program for operation of the life-safety smoke control system is initiated. The "program start" indicated in block 184 can be initiated simultaneously with the initiation of the program indicated in block 146 (FIG. 6) with the normal "start-up" program. Alternately, if it is desired that the smoke detection function to be described be carried out on a continuing basis, the end of program indicated in block 182 of FIG. 6 would merely mean the end of the "regular" program shown in FIG. 6 and described hereinbefore. The program described with reference to FIG. 7 would operate independently and the supply and return fans 12, 40 would operate at an "after hours" minimal speed to maintain some flow of air throughout the building's ducts to insure that the smoke detectors 50 would have a sampling of air from within the selected locations 25 moving past their detecting apparatus 50 at all times.

It should be noted that the smoke detectors 50 can be any standard smoke detector whether using a photocell or any other smoke-detecting means. In the preferred embodiment, an ionization-type smoke detector is preferred such as the detector manufactured by Pyrotronics Company for detecting the presence of particulate matter with the return air. Upon detection of a level of particulate matter or other contaminant in the return air above a pre-determined level, the smoke detector 50 closes a circuit and the central control apparatus 86 receives a signal from the smoke detector through the electrical conductor 100 that the specific smoke detector has detected smoke or other particulate matter, above said level, in the return air drawn from the selected location wherein it is situated.

Once the program illustrated in FIG. 7 has started, the initial instruction provided the central control apparatus 86 is to interrogate or read the first smoke detector 50 in a programmed sequence of smoke detectors which includes interrogation of every smoke detector circuit (smoke detector and associated circuitry) within the building, in turn, as indicated in block 186. Next, the decision element 188 is reached and inquires whether the specific smoke detector 50 which is being interrogated shows the presence of smoke in a specific location wherein the smoke detector is located, indicated by its circuit being closed.

If the circuit from the specific smoke detector being interrogated remains open (indicating that the specific smoke detector does not detect the presence of smoke or some other particulate matter), the decision element thus determining that the answer to the "smoke?" question is "no", block 190 is proceeded to next. The next smoke detector is incremented to and, according to block 186, is read. The decision element 188 then determines whether the next smoke detector detects the presence of smoke. If the answer to the "smoke?" question is "no" for that smoke detector, the next smoke detector is incremented to.

Incrementing to the next smoke detector and interrogating thereof occurs extremely rapidly and continues as long as decision element 188 determines that none of the smoke detectors 50 indicates the presence of smoke in any selected location 25.

As soon as the decision element 188 determines that one of the smoke detectors 50 shows a closed circuit, i.e., has detected the presence of the pre-determined level of smoke or some other particulate matter or noxious fumes, the block 192 is reached. The block 192 indicates that appropriate instructions are transmitted to a printing apparatus to print a permanent record of the location of the specific smoke detector 50 which detected smoke (or other particulate matter), the time of occurrence and any other information required by either local law or the desires of the installer of the specific system.

Next, block 194 is progressed to and an alarm is sounded. The alarm may either be an audible alarm, a visual alarm or a combination thereof. Further, the alarm may be confined to a central control area or may sound throughout the building depending upon design and may, if desired, be coupled with apparatus for automatically issuing instructions for safety procedures to be followed.

For the purposes of description, the smoke detector 50 sampling the atmosphere removed from a given selected location 25 on the ninth floor of the building B shown in FIGS. 1, 2 and 3 is taken as the one wherein smoke has been detected. Naturally, it is conceivable that smoke can be detected simultaneously by several smoke detectors 50 on several different floors or on several contiguous selected locations on one floor though it is recognized that this is unlikely.

Next, block 196 is progressed to wherein a signal is provided to interrupt the "normal" program shown in FIG. 6 irrespective of the specific location within the "normal" program sequence wherein the normal program may be located. Block 198 which is next reached indicates that the fan safety auxiliary controls for the intake and return fans 12, 40 (which controls prevent their operation at higher than normal speeds) are overridden to permit the operation of the fans 12, 40 at emergency levels in a manner to be described.

Next, block 200 is reached and indicates that dampers are to be positioned. This positioning is to a "smoke detection" position to be described.

Reference to FIG. 2 may be had for an illustration of "smoke condition" positioning of the dampers 28, 46, 82 when a fire or other smoke-causing condition or a given, pre-determined contaminant level is detected by detector or sensor 50 within a given selected location 25 on the ninth floor.

Signals are provided by the central control apparatus along the electrical conductors 110 to cause the electro-pneumatic actuators 30, on all but the given selected location or locations wherein smoke has been detected, to actuate the branch supply dampers 28 to the fully open position (see FIG. 2, all but the ninth floor). On the ninth floor (see FIG. 2) wherein smoke has been detected, the central control apparatus 86 causes the electro-pneumatic actuator 30 to operate the inlet branch dampers 28 to the fully closed position.

The central control apparatus 86 next provides signals along the conductors 102 to the actuators 48 to operate the return branch dampers 46 at all locations contiguous to the fire-detected selected location on the ninth floor to a fully closed position (see FIG. 2, all but the ninth floor). The central control apparatus 86 provides a signal to the actuator 48 on the ninth floor to operate the auxiliary return dampers 46 to a fully open position.

Next, the central control apparatus 86 provides a signal along the conductor 102 to the electro-pneumatic actuator 84 to operate the purge dampers 82 on the selected location 25 on the ninth floor to a fully opened position (see FIG. 2). The purge dampers 82 on the other, non-fire selected locations are maintained in their normally closed positions.

Next, the central control apparatus 86 provides a signal along the conductor 92 to the electro-pneumatic actuator 64 to operate the main outlet dampers 62 to the fully opened position. In addition, the central control apparatus 86 provides a signal along the conductor 94 to the electro-pneumatic actuator 58 to operate the main transfer dampers 56 to the fully closed position. In addition, the central control apparatus 86 provides a signal along the conductor 96 to the electro-pneumatic actuator 74 to operate the minimum fresh air dampers 72 to fully open if they are not already in that position. In addition, the central control apparatus 86 provides a signal along the conductor 98 to the electro-pneumatic actuator 70 to operate the main inlet dampers 68 to their fully open position.

Next, block 202 is progressed to wherein the output of both the supply and return fans 12, 20 is increased to "emergency" levels by operation of fan performance controls 79A, 79B. Next, block 204 is progressed to whereupon provision is made for actuating a printing apparatus to print the status of each of the dampers noted hereinbefore.

When the dampers and fans are operating as described and as shown in FIG. 2, the opening of the purge dampers 82 and the full opening of the auxiliary return dampers 46 on the ninth floor permits rapid removal of the atmosphere within the selected location 25 on the ninth floor. This rapid removal of the atmosphere within the selected location 25 is aided by the fact that the purge register 80 is much larger in area through which air may be taken in than is the normal return register 34 (which also remains fully open).

As may be noted by reference to FIG. 2, the branch return dampers 46 on all the locations contiguous to the location wherein smoke has been detected by the smoke detector 50 (here: the floors other than the ninth floor) have been operated to their fully closed position. Such a damper configuration greatly increases the negative, drawing pressure exerted by the return fan 40 on the atmosphere within the given selected location on the ninth floor through the connection with the main return passageway 38 and the auxiliary return passageway 36 through the registers 34, 80.

Also as may be noted by reference to FIG. 2, the branch supply dampers 28 on the emergency selected location 25 wherein smoke has been detected by the smoke detector 50 (the ninth floor) are actuated to their fully closed position thereby virtually preventing supply of any air to the given selected location on the ninth floor from the supply register 26 normally servicing that location.

Instead, air may only enter the given emergency selected location on the ninth floor through leakage from adjacent, contiguous non-smoke detected locations being supplied through supply registers 26 controlled by branch supply dampers 28 which are in the fully opened position. This provides a positive flow of air from non-smoke selected locations toward the given selected location on the ninth floor and prevents the spread and migration of the smoke and noxious fumes to other selected locations.

FIG. 2, shows the actuation of the main outlet dampers 62 to the fully open position. The open position for the dampers 62, coupled with closing of the dampers 56, permits evacuation of the smoke drawn out of the given selected location by the return fan 40 through the conduit 44 and the conduit 60 directly out of the building through the exhaust louvres $L_E$.

The aforementioned actuation of the main transport dampers 56 to the fully closed position further ensures against re-circulation of any smoke and/or noxious fumes into the atmosphere of any selected location on the ninth floor or any other floor through the system.

Operation of the minimum fresh air dampers 72 and the main inlet dampers 68 to their fully opened position permits supply of fresh air to the supply fan 12 through the main building supply louvres $L_F$, through the opening 66 within the main plenum 14, for distribution throughout the building by the fan 12 through its output 16. The fresh, outside air is supplied to the building B from the fan output 16, through the main air passageway 18 and the auxiliary supply passageways 22 to the registers 26 which are not blocked by fully closed inlet branch dampers 28, i.e., everywhere but on the given selected location on the ninth floor.

The "smoke condition" status as shown in FIG. 2 for the dampers and fans, as initiated by the procedural combination of steps shown in FIG. 7, may be maintained until an emergency safety operator seated at a central control area interrogates the smoke detector 50 within the given emergency selected location on the ninth floor and determines that the smoke condition no longer exists. When it is determined that a smoke condition no longer exists, the "normal" program shown in FIG. 6 may be reinitiated by manually resetting the dampers and fans, the "emergency" program shown in FIG. 7, having reached the block 206 after printing the damper status, and terminating any further emergency or smoke condition operations. The return to a "normal" fibrillation damper pattern must await a manual resetting of the dampers and fans and re-start at block 146.

Either at pre-determined intervals initiated automatically, or at a desired time initiated manually, the inlet branch dampers 28 servicing the given selected location 25 on the ninth floor may be opened (while either maintaining the other inlet branch dampers 28 open [see FIG. 3] or momentarily closing the other inlet branch dampers contiguous to the given selected location) in order to momentarily rapidly purge the atmosphere from the given selected location on the ninth floor.

During this "purge" operation shown in FIG. 3, the main outlet dampers 62 remain open, the main transfer conduit dampers 56 remain closed, the minimum fresh air dampers 66 and the main inlet dampers 68 remain open and the inlet fan 12 draws in fresh air from outside of the building. The return fan 40 exhausts all return air from the given selected location (the ninth floor) directly out of the building and no exhausted air is re-circulated through the ventilating or air conditioning system of the building.

It should be noted that throughout the foregoing description, the term "air conditioning", unless the context indicates otherwise, includes treating circulating air such as by heating, cooling, both heating and cooling as required, humidifying, dehumidifying or merely circulating the air.

The method and system which has been described herein can naturally be supplemented as desired or required by local ordinance. For example, if it is desired to determine with certainty that each of the dampers does in fact reach the position mandated for the damper by the central control apparatus 86, a device can be installed to indicate that the desired positioning of the damper has in fact occurred. Further, the central control apparatus 86 can be programmed to prevent incrementing to the next procedural step until such time as the indicating device provides a signal to the central control apparatus that the damper has attained the desired position.

In addition, the electro-pneumatic controls (which in the preferred embodiment are similar to those provided by Johnson Service Company under their No. Ep7320) may be any type of damper controls which would function in the recited environment in the required manner.

Further, if local law requires, fire dampers can be added at any desired location to function in the required manner either independently or under the control of the central control apparatus 86 so long as the fire dampers include control apparatus to permit their operation and to permit the functioning of the remainder of the apparatus described herein in the manner described hereinbefore.

As will be readily apparent to those skilled in the art, the present invention may be used in other specific forms or for other purposes without departing from its spirit or essential characteristics. The present embodiment is, therefore, to be considered as illustrative and not restrictive, the scope of the invention being indicated by the claims rather than by the foregoing description, and any changes which come within the meaning and range of equivalence of the claims are therefore intended to be embraced therein.

What is claimed is:

1. An improvement for use in a high rise building with a plurality of floors having air conditioning and ventilating duct members and control means for normally selectively controlling the flow of air to a plurality of selected locations in the building, said duct members including main air passageways extending vertically between said floors in said building, a plurality of auxiliary supply passageways and a plurality of auxiliary return passageways each extending horizontally between a main passageway and at least one selected location, a plurality of supply registers and a plurality of return registers, each communicating with at least one of said selected locations, each of said auxiliary supply passageways communicating with said selected locations through a corresponding supply register, each of said auxiliary return passageways communicating with said selected locations through a corresponding return register, a supply branch damper mounted relative to each auxiliary supply passageway, a return branch damper mounted relative to each auxiliary return passageway, each of said supply branch dampers and each of said return branch dampers including means being constructed and arranged for controlling, respectively, the flow of air into and out of each of said selected locations through said corresponding supply and return registers, said improvement comprising supply and return branch damper actuation means being operatively connected, respectively, to each of said supply and return branch dampers, means selectively controlling each of said supply and return branch damper actuation means to move said respective supply and return branch dampers between a fully opened position permitting substantially unrestricted air flow between said selected locations and said respective auxiliary passageways through said corresponding supply and return dampers and a fully closed position preventing substantially all air flow between said selected locations and said respective auxiliary passageways through said corresponding supply and return registers, said control means including means for selectively controlling said supply and return branch damper actuation means to move said supply and return branch dampers to at least one pre-selected position intermediate said fully opened and fully closed positions, said control means including means for normally cycling pre-selected supply and return branch dampers within said building between said fully opened and intermediate positions in a manner to reduce and conserve the total energy necessary to supply conditioned air to all of said selected locations within said building by maintaining a pre-selected percentage of said branch supply and return dampers in said intermediate position according to a pre-determined schedule.

2. The invention according to claim 1 including means for changing said intermediate position of said branch supply and return dampers to a desired percentage of said fully opened position.

3. The invention according to claim 1 including a plurality of purge registers each communicating with at least one of said selected locations, said auxiliary return passageways communicating with each of said selected locations through a corresponding purge register, a purge damper being mounted relative to each of said auxiliary return passageways, each of said purge dampers including means being constructed and arranged for controlling the flow of air out of each of said selected locations through a corresponding purge register, each of said purge damper actuation means being operably connected to respective purge dampers and operable to normally move said respective purge dampers to a fully closed position preventing substantially all air flow between said selected locations and said respective auxiliary return passageways through said corresponding purge registers, each of said purge damper actuation means being operable, in an emergency, to move said respective purge dampers to a fully opened position permitting full communication between said selected locations and said auxiliary passageway through said corresponding purge registers, said control means also being operable, upon an emergency existing in a given one of said selected locations to actuate said purge damper in communication with said given emergency selected location to said fully opened position, to actuate said return branch damper in communication with said given emergency selected location to said fully opened position, to actuate said supply branch damper in communication with said given emergency selected location to said fully closed position, to actuate said return branch dampers at selected locations contiguous to said given emergency selected location to said fully opened position, to actuate said supply branch dampers at said contiguous selected locations to said fully opened position thereby rapidly removing said atmosphere from said given emergency selected location and preventing migration and spread of said atmosphere to other contiguous selected locations.

4. The invention according to claim 3, said duct members including main openings communicating said main passageways with the outside of said buildings, main dampers positioned relative to said main openings and including means being constructed and arranged for selectively opening and closing said main openings, main damper actuation means being operatively connected to each of said main dampers for moving said main dampers between a fully opened position permitting substantially full communication between said main passageways and the outside of said building through said main openings and a fully closed position closing off substantially all communication between said main passageways and the outside of said building through said main openings, said control means being operable upon an emergency existing in a given selected location to actuate said main dampers to said fully opened position thereby permitting full communication between said main passageways and the outside of said building.

5. The invention according to claim 4 including means operable to prevent all communication between said auxiliary supply passageways and said auxiliary return passageways through said duct members, said control means being operable to move said last named means to prevent said communication between said auxiliary supply passageways and said auxiliary return passageways through said duct members upon an emergency existing in one of said given selected locations.

6. The invention according to claim 2 including an emergency sensor in communication with each of said selected locations, each of said emergency sensors including means being constructed and arranged to sensing a predetermined level of contaminants in the air being removed from each of said selected locations and means operatively connecting each of said emergency sensors to said control means.

7. In a high rise building having a plurality of selected locations, the method of normally supplying conditioned air to said building through a plurality of supply and return passageways communicating with a plurality of selected locations through corresponding supply and return registers in a manner to reduce and conserve the consumption of air conditioning energy, said method comprising normally providing conditioned air to and removing air from a pre-determined number of selected locations at a rate which is a pre-determined reduced percentage of the full capacity of said air conditioning system, simultaneously providing conditioned air to and removing air from the remaining number of said selected locations at said full rate, and cyclically varying the specific selected locations being supplied with conditioned air and having air removed therefrom at said reduced pre-determined percentage of said full rate.

8. The invention according to claim 7 including operating said normal air conditioning supply and return passageways as an emergency evacuation system including providing emergency purge registers, each being larger than said supply and return registers in communication with each of said selected locations, normally preventing movement of air from each of said selected locations through said purge registers, providing sensor means in communication with each of said selected locations for sensing the existence of at least a pre-determined level of contaminants in air removed from each of said selected locations and generating a signal in response thereto, providing means for supplying said signal analogous to the existence of at least said pre-determined level of contaminants at each of said selected locations to a central control apparatus, upon receipt of said signal from said sensor apparatus said control apparatus interrupting said normal supplying of said air through said supply and return registers, permitting full rate removal of air through said emergency purge register in communication with an emergency selected location wherein said sensor senses the presence of a level of contaminants at least equal to said pre-determined level, removing air at said full rate through said return register in communication with said emergency selected location, preventing supply of air through said supply register in communication with said emergency selected location, permitting supply of air through supply registers in communication with selected locations contiguous to said given emergency selected location, preventing removal of air through return registers in said selected locations contiguous to said emergency selected location thereby containing said contaminants within said emergency selected location and preventing the migration and spread thereof to contiguous selected locations.

* * * * *